United States Patent [19]

de Jong et al.

[11] Patent Number: 4,551,699

[45] Date of Patent: Nov. 5, 1985

[54] ROTARY VARIABLE DIFFERENTIAL TRANSFORMER

[75] Inventors: Joannes N. M. de Jong, Westford; Richard L. Earle, Mendon, both of Mass.

[73] Assignee: Sperry Corporation, New York, N.Y.

[21] Appl. No.: 721,121

[22] Filed: Apr. 8, 1985

Related U.S. Application Data

[62] Division of Ser. No. 506,929, Jun. 22, 1983, abandoned.

[51] Int. Cl.[4] ..... H01F 21/06

[52] U.S. Cl. ..... 336/135

[58] Field of Search ..... 336/130, 131, 132, 134, 336/135, 120

[56] References Cited

U.S. PATENT DOCUMENTS

| | | | |
|---|---|---|---|
| 2,445,427 | 7/1948 | Godsey, Jr. | 336/135 X |
| 3,398,386 | 8/1968 | Summerlin | 336/135 |
| 3,551,866 | 12/1970 | Chass | 336/135 X |
| 3,573,693 | 4/1971 | Chass | 336/135 |
| 3,882,436 | 5/1975 | Chass | 336/135 X |

FOREIGN PATENT DOCUMENTS

| | | | |
|---|---|---|---|
| 438931 | 1/1975 | U.S.S.R. | 336/135 |

*Primary Examiner*—Thomas J. Kozma

*Attorney, Agent, or Firm*—Howard P. Terry; Seymour Levine

[57] ABSTRACT

A rotary variable differential transformer has coil windings at an angle with respect to the longitudinal axis of the transformer and a core rotatable about this axis with end faces cut at projected angles therewith such that a rotation of the core varies the coupling between the primary and secondary windings. Amplitude and phase variations at the secondary windings are measurements of core rotation.

6 Claims, 13 Drawing Figures

ROTARY VARIABLE DIFFERENTIAL TRANSFORMER

This is a divisional of co-pending application Ser. No. 506,929, now abandoned, filed on June 22, 1983.

BACKGROUND OF THE INVENTION

1. Field of the Invention

The invention relates to variable transformers and more particularly to transformers variable as a function of the rotation angle of a magnetic susceptible core.

2. Description of the Prior Art

Differential transformers of the prior art are generally produced with a single primary winding and two secondaries, linearly disposed along a common axis. The windings possess a common magnetic circuit comprising a longitudinally displacable iron core. The split secondary may be wound additively or differentially to provide a peak or null at the output terminals when the iron core is positioned to establish equal coupling between the two sections of the secondary and appropriate variations at the output terminals when the iron core is longitudinally displaced from this position.

This arrangement is useful for measuring linear displacements. The measurement of rotational displacements, however, requires elements to convert rotational motions to linear motions and may adversely effect the accuracy and sensitivity of the measurements. Thus for many applications a direct rotational differential transformer is desired.

SUMMARY OF THE INVENTION

A differential transformer constructed in accordance with the principles of the present invention includes a primary coil wound at an angle about a longitudinal axis and electrically coupled secondary coils wound on either side of the primary winding at projected angles with respect to the longitudinal axis that may be different for each secondary coil winding and from the angle of the primary coil winding. In one embodiment of the invention the primary and each of the two sections are wound at equal angles to the longitudinal axis. A rotatable cylindrical core of magnetic susceptible material, having one end face at an angle to the longitudinal axis that is substantially equal to the coil winding angle and the other end face at an angle to the longitudinal axis that is substantially equal to the supplement of the coil winding angle, thus providing two end faces for the cylindrical core at substantially equal and opposite angles to the longitudinal axis is positined in the cylindrical regions formed by the coil windings. Rotation of the core varies the coupling between the primary and the sections of the secondary, thereby establishing a variable output signal.

In a second embodiment of the invention the primary coil is wound at an angle to the longitudinal axis that is substantially 90° while the two sections of the secondary coil are slanted with respect to the longitudinal axis to form substantially equal and opposite projected angles with respect thereto. A rotatable cylindrical core of magnetically susceptible material, having a length substantially equal the length of the transformer along the longitudinal axis and end faces that form an angle therewith substantially equal to on of the coil winding angles, is inserted in the cylindrical space formed by the coil windings. In one position of the core the primary is coupled to one section of the secondary while a rotation of 180° therefrom the coupling is to the second section of the secondary.

Another embodiment of the invention has the primary and both sections of the secondary wound perpendicularly about the longitudinal axis to form a cylindrical hollow region about the longitudinal axis. A cylindrical ring of magnetic susceptible material is inserted in the cylindrical region formed by the coil windings adjacent to the first and second sections of the secondary coils. The end of each ring facing the central primary winding is cut at an angle with respect to the longitudinal axis, the angle of one end face being substantially equal to the angle of the other, to establish a cylindrical ring with the shortest length parallel to the longitudinal axis substantially equal to the length of the secondary coil section along the longitudinal axis and the longest length, 180° removed from the shortest length, spanning a portion of the separation distance between the section of the secondary and the central primary winding, thereby establishing parallel end faces for the two circular rings. A rotatable ring of magnetic susceptible material with one end face at an angle to the longitudinal axis substantally equal to the angle of the inner end faces of the fixed rings of magnetic susceptible material and a second end face at an angle to the longitudinal axis that is substantially equal to the supplementary angle thereof, the end faces having equal and opposite angles relative to the longitudinal axis, is positioned to extend through the cylindrical region formed by the primary winding to have one end face adjacent and parallel to an end face of one of the fixed rings so that there is no overlapping of the magnetic susceptible material of the fixed and rotatable rings. The second end face of the rotatable ring is at the supplementary angle to the second stationary ring of magnetic susceptible material, such that an overlapping of magnetically susceptible material occurs, thereby coupling the second section of the secondary to the primary windings. When the rotatable ring undergoes a 180° rotation the overlapping occurs with the stationary ring of the first section of the secondary windings while the end face of the second stationary ring and that of the rotatable ring are substantially parallel with no overlapping.

In another embodiment the end face angles of the rotatable magnetic susceptible material are substantially parallel while the inner end faces of the fixed rings within the sections of the secondary form supplementary angles.

Another embodiment of the invention utilizes a primary coil positioned between first and second sections of a split secondary all wound perpendicularly to a longitudinal axes. Cylindrical cores of magnetic susceptible material are fixedly positioned in the cylindrical regions formed by the first and second sections of the secondary windings. Each core extends a predetermined distance from the secondary section towards the primary winding and has a V notch cut therein. A third core of magnetic susceptible material, rotatable within each fixed core of the two sections of the secondary windings, V matched at either end with 90° displacement therebetween at angles substantially equal to the V notch angles of the two fixed cores, extends through the cylindrical region within the primary windings and overlaps the magnetic susceptible material of one of the fixed cores in one position and overlaps the magnetic susceptible material of the other core when rotated 90°. Thus coupling is varied from the primary to one section of the secondary for a first position of the rotatable core and from the primary to the second section of the secondary at a position 90° from the first angular position.

In still another embodiment primary and secondary coils are perpendicularly wound about a longitudinal axis and adjacently positioned. A ring of magnetic susceptible material extends through the cylindrical region formed by the primary and secondary windings. A cylindrical magnetic susceptible material, having an axis substantially coincident with the longitudinal axis and rotatable whereabout and having end faces at substantially equal angles to the longitudinal axis, couples the primary and secondary coils to establish a predetermined polarity for the transformer when the rotatable magnetic susceptible material is in one position and an opposite polarity thereto when the rotatable magnetic susceptible material is rotated 180° from the first position. The rotation of the rotatable core therefore establishes a coupling that continuously varies between the two polarity peaks.

DESCRIPTION OF THE PREFERRED EMBODIMENTS

Figure 1A:
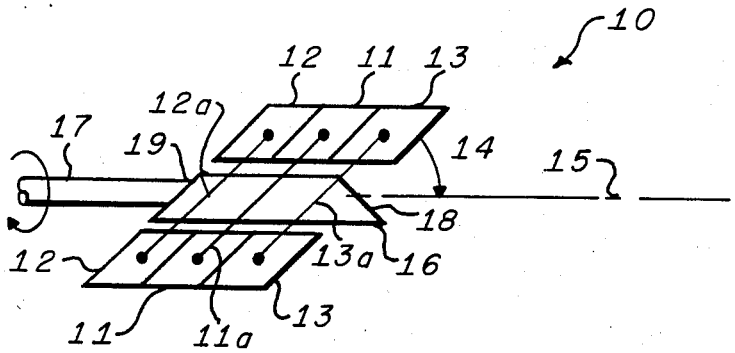
FIGS. 1A and 1B are schematic diagrams of an embodiment of the invention having the primary and the first and second sections of the secondary all wound at equal angles to the longitudinal axis.
Figure 1B:
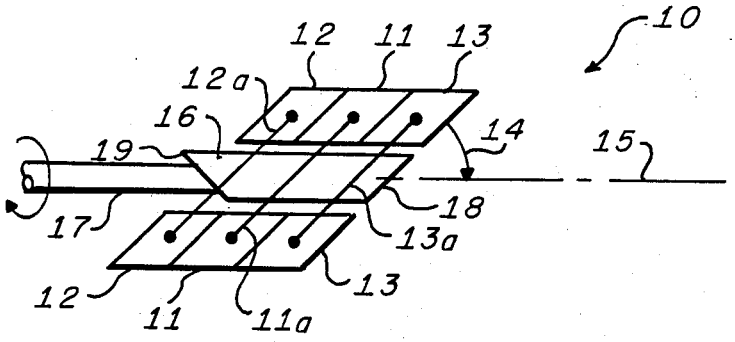

Referring now to FIGS. 1A and 1B there is illustrated an embodiment of the invention in which a primary coil 11 and secondary coil having electrically coupled sectios 12, 13, respectively represented by lines 11*a*, 12*a*, and 13*a* form equal projected angles 14 with a longitudinal axis 15. A cylindrical core 16 made of a material having high magnetic susceptibility is positioned with its axis substantially in alignment with the longitudinal axis 15 and rotatable thereabout by means of a shaft 17. End faces 18, 19 of the core 16 form equal and opposite angles with the axis 15 that are substantially equal to the angular value of the angle 14. In one position of the core, such as that shown in FIG. 1A, the end loops of the secondary section 12 and the end face 19 of the rotatable core 16 lie in a plane that is at the angle 14 with respect to the longitudinal axis 15, while the end face 18 of the rotatable core 16 slants away from the secondary section 13. In this position the coupling between the primary coil 11 and the secondary section 12 is at a maximum, while the coupling between the primary coil 11 and the secondary section 13 is at a minimum. When the core 16 is rotated 180° to the position shown in FIG. 1B the end face 18 and the end loops of secondary section 13 are in a common plane that forms an angle 14 with the longitudinal axis 15 while the end face 19 slants away from the secondary section 12. In this position the coupling between the primary coil 11 and the secondary section 13 is at a maximum while the coupling between the primary coil 11 and the secondary section 12 is at a minimum. Thus, the 180° rotation has caused a polarity change for the secondary winding, providing equal and opposite couplings for the core positions in FIGS. 1A and 1B and couplings therebetween that vary as a function of the rotation angle.

Figure 2A:
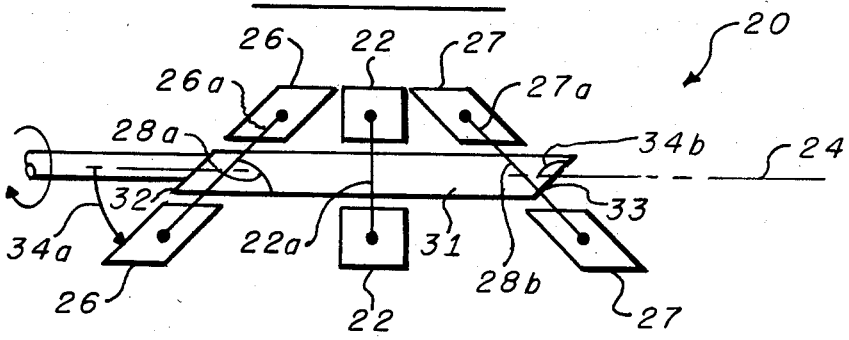
FIGS. 2A and 2B are schematic diagrams of an embodiment of the invention having the primary wound perpendicularly to the longitudinal axis with the first and second sections of the secondary wound at equal and opposite angles to the longitudinal axis.
Figure 2B:
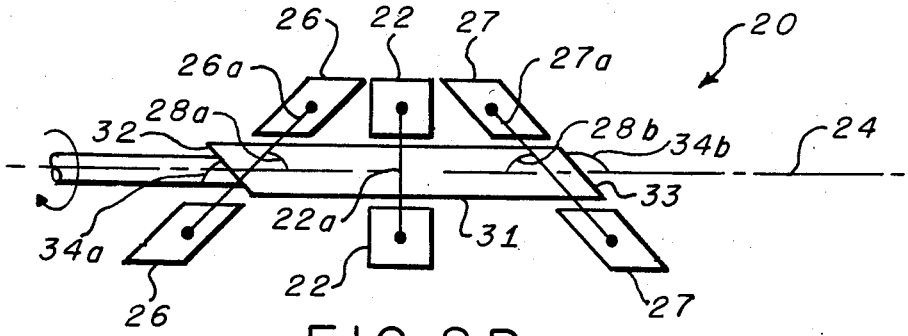

FIGS. 2A and 2B show an embodiment of the invention 20 having a primary coil 22 with windings, represented by the line 22*a* forming a projected angle of substantially 90° with longitudinal axis 24 and a secondary with electrically coupled coils 26, 27, respectively represented by lines 26*a*, 27*a*, forming equal projected internal angles 28*a*, 28*b*. A cylindrical core 31 of high magnetic susceptible material, having end faces 32, 33 forming corresponding angles 34*a*, 34*b* with longitudinal axis 24 that are substantially equal to the projected internal angles formed by the coils 26*a*, 27*a* with the longitudinal axis, is positioned with its axes substantially coincident with the longitudinal axis 24. In one position of the core 31 the end face 32 and the outer loops of the secondary section 26 lie in a common plane, the core 31 extending therefrom through the secondary section coil 26 and the primary windings 22, thereby providing maximum coupling between the primary 22 and secondary section 26. For this position of the core the end face 34*b* slants away from the secondary section 27 providing minimum coupling between the primary windings 22 and the secondary section windings 27. When the core 31 is rotated 180° from the position in FIG. 2A, as shown in FIG. 2B, the end face 33 of the core 31 lies in a common plane with the end loop of the secondary section winding 27, the core 31 extending therefrom through the primary winding 22 to establish maximum coupling between the primary winding 22 and the secondary section winding 27 while the coupling between the primary winding 22 and the secondary section winding 26 is at a minimum. Thus a transformer polarity change is accomplished with 180° rotation of the core 31 and a coupling variation as a function of core 31 rotation angle is realized.

Figure 3A:
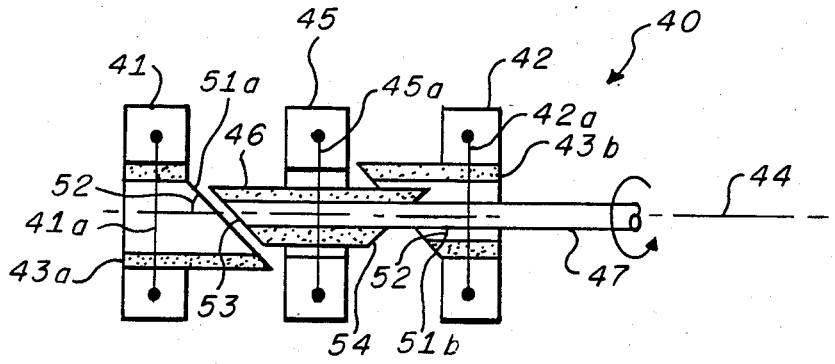
FIGS. 3A, 3B, and 3C are schematic diagrams of embodiments of the invention having the primary and both sections of the secondary wound perpendicularly to the longitudinal axis.
Figure 3B:
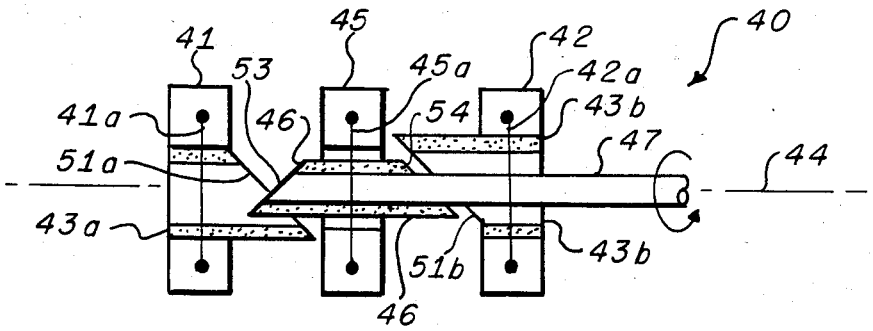
Figure 3C:
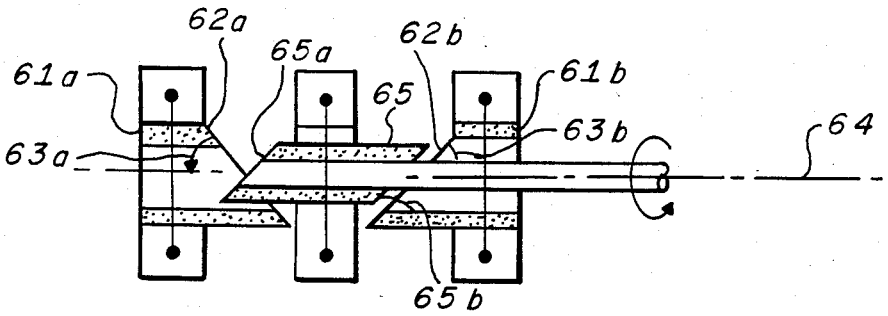

FIGS. 3A, 3B, and 3C illustrate embodiments of the invention in which electrically coupled sections of the secondary are wound about fixed sections of a core made of magnetic susceptible material. In FIG. 3A and 3B the variable transformer 40 comprises electrically coupled sections 41, 42 of the secondary wound about fixed rings 43*a* and 43*b* of magnetic susceptible material at an angle of 90° to the longitudinal axis (represented by lines 41*a* and 42*a* respectively), the primary 45 wound at an angle of 90° to the longitudinal axes (represented by line 45*a*), and a core of magnetic susceptible material 46 positioned on a shaft 47 for rotation about the longitudinal axis 44. The fixed sections 43*a* and 43*b* have end faces 51*a* and 51*b* respectively that are substantially parallel and form an acute projected angle 52 with the longitudinal axis 44. The rotatable core 46 has end faces 53, 54 that form projected acute angles with the longitudinal axes 44 that are equal and opposite to the angle 52. When the rotatable core is in one position, such as that in FIG. 3A, the core 46 extends alaong the shaft 47 such that the end face 53 of the rotatable core 46 is parallel to and in close proximity with the end face 51*a* of the stationary core section 43*a* and end face 54 of the rotatable core 46 intersects end face 51*b* of the stationary core section 43*b* to establish an overlapping between the magnetic susceptible material of the rotatable core 46 and the magnetic susceptible material of the stationary core section 43*b*. When the rotatable core 46 is rotated 180° from this position, as shown in FIG. 3B, the end face 53 intersects end face 51*a* establishing an overlapping between a magnetic susceptible material of the core 46 with the magnetic susceptible material of the stationery cross-section 43*a* thus establishing maximum coupling between the primary coil 45 and secondary coil section 41. Between these two maximum coupling positions the coupling between the primary and secondary coils varies as a function of rotation angle, thereby providing a rotary differential transformer.

A variant of the embodiment of FIGS. 3A and 3B is shown in FIG. 3C. The stationary core sections 61*a*, 61*b* have end faces 62*a*, 62*b* respectively that form equal and opposite acute angles 63*a*, 63*b* with the longitudinal axis 64, while the end faces 65*a*, 65*b* of the rotatable core of magnetic susceptible material 65 form equal projected acute angles with the longitudinal axis 64 that are substantially equal to the angular value ofacute angles 63*a*, 63*b*. A rotation of the core 65 provides a coupling variation similar to that described for FIGS. 3A, 3B.

Figure 4A:
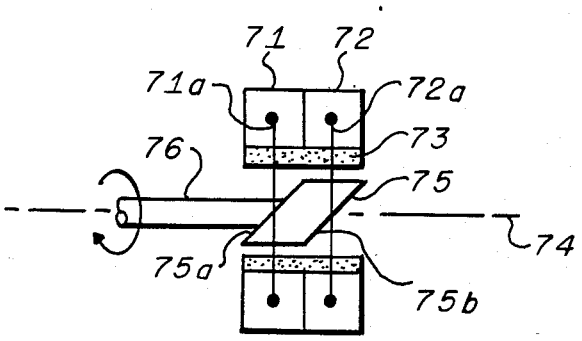
FIGS. 4A and 4B are schematics of an embodiment of the invention having a primary and a single section secondary both wound perpendicularly to the longitudinal axis.
Figure 4B:
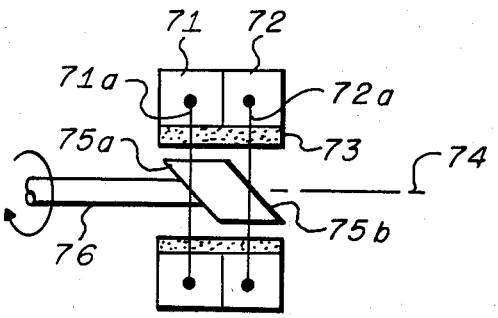

Referring now to FIGS. 4A and 4B, wherein a variable differential transformer 70 with a single section secondary coil is shown. Primary 71 and single section secondary 72 coils, represented by lines 71*a* and 72*a* respectively, are wound about a ring 73 of magnetic susceptible material in a manner to form a projected angle of 90° with the longitudinal axis 74. A cylinder 75 of magnetic susceptible material, rotatable about the longitudinal axis 74, has end faces 75*a*, 75*b* that form projected angles with the longitudinal axis 74 such that, for the position shown in FIG. 4A, coupling between the primary and secondary coils is increased over that realized through the stationary core 73 through the lower portion of the primary 71 and the upper portion of the secondary 72. When the cylinder is rotated 180° this increase in coupling is accomplished through the upper portion of the primary 71 and the lower portion of the secondary 72. These two positions provide the maximum increase in coupling and represent polarity changes therefor. As the cylinder 75 rotates the increased coupling vary as a function of rotation angle to provide the rotary differential transformer.

Figure 5A:
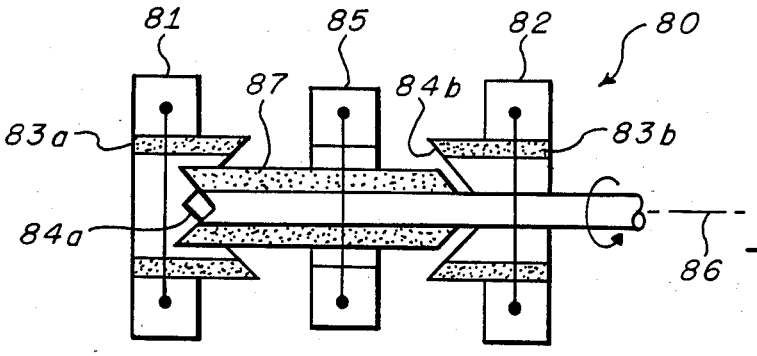
FIGS. 5A, 5B, and 5C depict an embodiment of the invention having the primary and first and second sections of the secondary wound perpendicularly to the longitudinal axis and a cylindrical core rotatable about the longitudinal axis and having V notches at either end with 90° angular spacing therebetween.
Figure 5B:
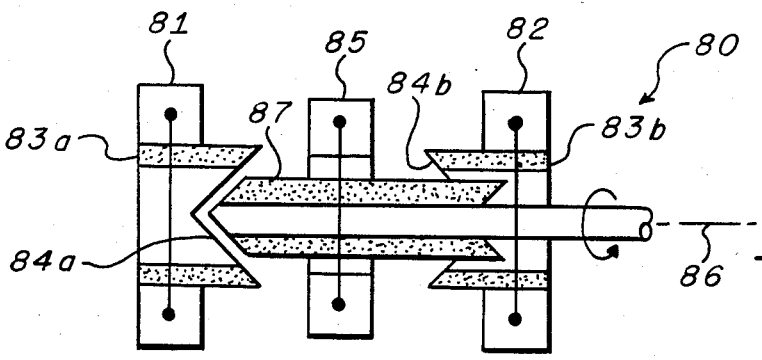
Figure 5C:
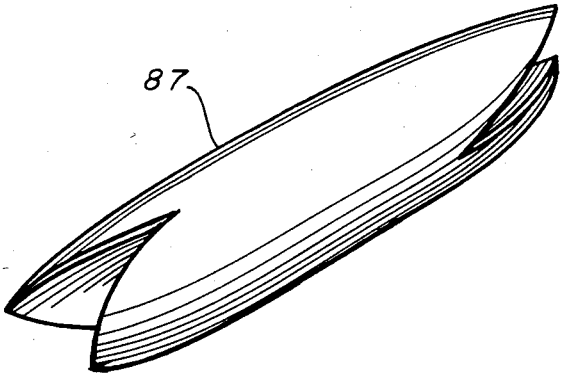
Figure 5D:
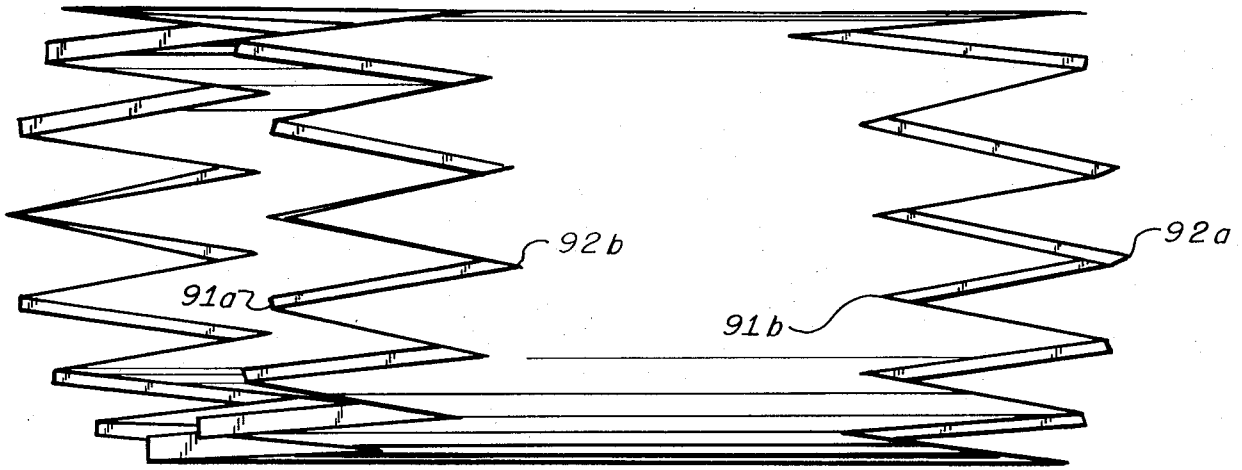
FIG. 5D depicts a rotatable core with a multiplicity of notches at each end.

FIGS. 5A, 5B and 5C illustrate an embodiment of the invention 80 wherein first and second sections 81, 82 of a secondary coil are wound about fixed cylindrical cores 83*a*, 83*b* of magnetic susceptible material, having substantially equal V-notches 84*a*, 84*b* oriented at substantially equal angular positions relative to a common reference. The primary coil 85 is wound about the longitudinal axis 86 to form a projected angle therewith of substantially 90° as do the two sections 81, 82 of the secondary coil, to form a cylindrical region about the longitudinal axis 96 that is of a diameter substantially equal to the inner diameter of the fixed core rings 83*a*, 83*b*. A rotatable cylindrical core 87 of magnetic susceptible material with V-notches at either end thereof angularly positined with 90° separation therebetween having apex angles substantially equal to the apex angles of the V-notches in the fixed coils 83*a*, 84*b*, as shown in FIG. 5C, extends through the cylindrical region formed by the windings of the primary coil 85 into the cylindrical regions formed by the magnetic susceptible rings of the stationery coils 83*a*, 83*b* to overlap with the notches thereof. In one position of the rotatable core, shown in FIG. 5A, a maximum overlapping of the magnetic susceptible material of the rotary core 87 and the fixed core 83*a* occurs while a minimum overlapping of the magnetic susceptible material of the rotary core 87 and the fixed core 83*b* is realized. When the core 87 is rotated 90° from the position of 5A the overlapping is reversed, as shown in FIG. 5B. The orientation in FIG. 5B provides maximum overlapping between the magnetic material of the rotatable core 87 and the fixed core 83*b* while minimum overlapping between the magnetic susceptible materials of the core 87 and 83*a* is realized. Thus a rotation of the core 87 varies the coupling between the primary and secondary windings between values determined by the two conditions depicted in FIGS. 5A and 5B, this variation repeating after every 90° rotation of the rotatable cone 87. Those skilled in the art will recognized that the frequency of coupling variation may be increased by equally spacing a multiplicity of V-notches about the rotatable core and orienting the notches on either end to provide an apex for one in longitudinal alignment with a valley of the other, as shown in FIG. 5D as apex-valley pairs 91*a*, 91*b* and 92*a*, 92*b*.

While the invention has been described in its preferred embodiments, it is to be understood that the words which have been used are words of description rather than limitation and that changes may be made within the purview of the appended claims without departing from the true scope and spirit of the invention in its broader aspects.

We claim:

1. A rotary variable transformer comprising:

electrically coupled first and second coils of electrical conducting material cylindrically wound about a longitudinal axis forming first and second hollow cylinders respectively;

a third coil of electrical conducting material positioned between said first and second coils and cylindrically wound about said longitudinal axis forming a third hollow cylinder;

first and second rings of circumferentially continuous magnetic susceptible material respectively positioned in said first and second hollow cylinders, each having an extension toward said third hollow cylinder configured to have a circumferential variation of magnetic susceptible material; and a core of circumferentially continuous magnetic susceptible material rotatably positioned in said third hollow cylinder having extensions towards said first and second hollow cylinders configured to have a circumferential variation of magnetic susceptible material to provide maximum magnetic coupling with said extension of said first ring and minimum magnetic coupling with said extension of said second ring for at least one angular rotation position and to provide maximum magnetic coupling to said extension of said second ring and minimum magnetic coupling to said extension of said first ring at preselected angles from each of said at least one angular rotation position.

2. A rotary variable transformer in accordance with claim 1 wherein said circumferential variation of said first and second rings, and said rotatable core is a diminishing circumferential arc forming a taper.

3. A rotary variable transformer in accordance with claim 2 wherein said tapers of said first and second ring extensions each form an acute angle with said longitudinal axis and said tapers of said rotatable core extensions form equal and opposite angles with respect to said longitudinal axis having angular values substantially equal to said acute angle, said rotatable core extending from said third hollow cylinder to provide maximum magnetic coupling to said first ring and minimum magnetic coupling to said second ring at a first angular rotation position and maximum magnetic coupling to said second ring at an angular rotation of 180° from said first angular rotation position.

4. The rotary varible transformer in accordance with claim 2 wherein said tapers of said first and second ring extensions form equal and opposite acute angles with said longitudinal axis and said core extension tapers form acute angles with said longitudinal axis equal to said first and second ring taper acute angles said rotatable core extending from said third hollow cylinder to provide maximum magnetic coupling to said first and minimum magnetic coupling to said second ring at a first angular rotation positon and maximum magnetic coupling to said second ring and minimum magnetic coupling to said first ring at an angular rotation position 180° from said first angular rotation position.

5. A rotatable variable transformer in accordance with claim 1 wherein said circumferential variation of said first and second ring extensios comprises equal V-notches forming apexes that are positioned at equal rotation angles with respect to a predetermined reference and said rotatable core extensions are V-notched at angles equal to said V-notch angles of said first and second ring extensions to form apexes with predetermined angular separation therebetween, such that maximum magnetic coupling to said first ring and minimum magnetic coupling to said second ring is provided at a first rotation angle and rotation angles thereafter equal to said rotation angle separation of said apexes and maximum magnetic coupling to said second ring and minimum magnetic coupling to said first ring is provided at a rotation angle equal to said predetermined separation angle from said first rotation angle and at rotation angles thereafter equal to said rotation angle separation of said apexes.

6. A rotatable variable transformer in accordance with claim 5 wherein said predetermined angular separation is 9°.

* * * * *